US011767085B2

(12) United States Patent
Rudofsky

(10) Patent No.: US 11,767,085 B2
(45) Date of Patent: Sep. 26, 2023

(54) CHASSIS TO CONNECT MOTORIZED SURF BOOTS, OR OTHER MULTI-BODY VEHICLES

(71) Applicant: Keith Maximilian Rudofsky, Fort Lauderdale, FL (US)

(72) Inventor: Keith Maximilian Rudofsky, Fort Lauderdale, FL (US)

( * ) Notice: Subject to any disclaimer, the term of this patent is extended or adjusted under 35 U.S.C. 154(b) by 27 days.

(21) Appl. No.: 17/237,960

(22) Filed: Apr. 22, 2021

(65) Prior Publication Data

US 2021/0276670 A1 Sep. 9, 2021

Related U.S. Application Data

(60) Provisional application No. 62/986,656, filed on Mar. 7, 2020.

(51) Int. Cl.
*B63B 32/70* (2020.01)
*B63B 32/10* (2020.01)

(52) U.S. Cl.
CPC ..... *B63B 32/70* (2020.02); *B63B 32/10* (2020.02)

(58) Field of Classification Search
CPC ..... B63B 32/00; B63B 32/10; B63B 32/70
USPC ..... 440/6
See application file for complete search history.

(56) References Cited

U.S. PATENT DOCUMENTS 5,643,029 A 7/1997 Rudofsky
5,848,574 A * 12/1998 Lande ..... B63B 7/02 114/61.11

* cited by examiner

*Primary Examiner* — Lars A Olson

(57) ABSTRACT

The current invention offers an instrumental improvement to the prior art of USPTO Rudofsky U.S. Pat. No. 5,643,029 Motorized Surf Boots by providing a connecting Chassis Assembly that provides a rider the ability to lean into or "carve" through a turn (like a downhill snow skier or in-line roller skater does) while keeping each of the boards of the Motorized Surf Boots parallel to each other, at a predetermined distance from each other, and in-line with each other (meaning one board will not shift ahead or lag behind the other).

Also included in this chassis invention is a device that provides an automatic and adjustable dampened spring back action, which serves to re-center the Chassis, thus the Surf Boots back into an upright or vertical position, in order to assist the rider in controllably ending the "carving" action and instead continue to move in a straight direction.

2 Claims, 5 Drawing Sheets

CHASSIS TO CONNECT MOTORIZED SURF BOOTS, OR OTHER MULTI-BODY VEHICLES

CROSS-REFERENCE TO RELATED PATENTS

The current invention offers an improvement to the prior art of USPTO Rudofsky U.S. Pat. No. 5,643,029 Motorized Surf Boots, regarding the teaching in column 4, lines 28-43, " . . . to maintain the boards from separating . . . ", " . . . are a pair of rigid links . . . ", "Shown with a pivotable connection typical ball and socket arrangement at 74, the two links 70 and 72 hold the boards at a fixed position relative to each other but allow each board to pivot about the connection at 74."

BACKGROUND OF THE INVENTION

It's common for water skiers, snow skiers, and in-line roller skaters to lean into turns using body English in order that they do not fall over to the outside of a turn while negotiating it. Changing the angle of the skis or skates off of a vertical orientation, creating an acute angle to the inside of a turn is commonly known as "carving" into a turn and helps to change the direction of motion of the skis or skates.

In the operation of U.S. Pat. No. 5,643,029 Motorized Surf Boots, and in negotiating a turn, the same angular adjustment or "carving" action needs to be performed in order to effectively steer through a turn, whether the rider is traversing water or land. While the existing U.S. Pat. No. 5,643,029 Motorized Surf Boots includes a means for connecting and disconnecting the pair of Surf Boots, in actual operation it was discovered that there exist too many degrees of freedom of movement that results from the ball and socket arrangement connection with only a single forward link and a single rearward link as described in U.S. Pat. No. 5,643,029 column 4, line 28-43. The arrangement of rigid links described in the previous art may result in the rider not being able to balance or negotiate turns effectively while operating the pair of Surf Boots.

While the arrangement of connecting links discussed in the previous art does fix the distance between each of the boards of the Motorized Surf Boots, it does not keep the Motorized Surf Boots parallel with respect to each other or remain in-line with each other (meaning that one Surf Boot may be free to shift further ahead or lag behind the other), during operation.

BRIEF SUMMARY OF THE INVENTION

It is an object of the present Chassis invention to provide the rider of Motorized Surf Boots or other multi-hull or multi-body vehicles that are arranged somewhat like a like a catamaran, an interconnecting Chassis that can be positioned between each individual Surf Boot, or hull, which provides a rider the ability to lean into or "carve" through a turn while keeping each of the boards of the Motorized Surf Boots, or hulls, at all times parallel to each other, at a predetermined distance from each other, and in-line with each other (meaning one board will not shift ahead or lag behind the other).

It is also an object of the present invention to include within the said Chassis, a device that provides an automatic dampened spring back action, which will serve to re-center the Chassis, thus the Surf Boots, or multi-hull craft, back into an upright or vertical position, in order to assist the rider in controllably ending the "carving" action and instead continue to move in a straight direction.

It is another object of the invention to provide the user of said Chassis invention a means to quickly connect and disconnect the said Chassis invention from between each of the Surf Boots, or any multi-hull craft where it may be fitted.

It will become clear from the following description, that the while the apparatus of the present invention is being illustrated for use on Motorized Surf Boots, the utility can be easily incorporated into the designs of any size multi-hull craft, affording the same functionality of carving into, and out of a turn, to the end that steering performance is enhanced.

The complete Chassis to Connect Motorized Surf Boots of the present invention will be seen to be comprised of a front Chassis Assembly and a rear Chassis Assembly, each of which connects the pair of boards in the case of U.S. Pat. No. 5,643,029 Motorized Surf Boots. Additionally, the present invention can be scaled-up in size for use on other multi-body vehicles such as a catamaran type boat. The front assembly and the rear assembly of the present invention are each configured into what is commonly known as a "four-bar linkage", such that each of the vertical links are attached respectively to each of the boards, or hulls of a multi-hull craft. In such an arrangement, the front and rear chassis assemblies will keep the boards, or hulls, parallel to each other at a predetermined distance, whether travelling straight or leaning "carving" into a turn. Basically, when travelling in a straight direction the chassis will be seen from a front or rear view, to be in the shape of a rectangle. When leaning or "carving" into a turn, the four-bar linkage of each the chassis assemblies will be seen from a front or rear view, to act as a parallelogram.

Alternatively, the shape of any the four bars comprising the four-bar linkage is not required to be a straight shaped segment, as the shape of the links can be varied greatly without deviating from the scope of this teaching. The materials used in construction of the components comprising the present Chassis invention can be made from any suitable materials or combination thereof.

In a preferred embodiment of the present invention, order to provide the said spring back action to end the "carving" action, incorporated into the four-bar linkage of each chassis assembly, are two additional crisscrossed links are incorporated, each of which include an inline spring and/or damper. The resulting geometry of the of the four-bar linkage, when transitioning from the rectangular shape into a shape of a parallelogram, while leaning or "carving" into a turn, will cause one of the crisscrossed links to stretch in length, thus actuating its inline spring and/or damper. Thus, the crisscrossed links will provide an automatic spring back action, causing the four-bar linkage to want to return to a rectangular shape, essentially aiding the rider of Surf Boots or the hulls of multi-hull boat to proceed out of a turn and proceed in a straight direction. While a set of crisscrossed links with said springs and said dampers will be seen in the drawings, for those skilled in the art, there are certainly alternative arrangements of spring type devices that can be installed into the construction of the present Chassis invention, that will provide the same purpose.

BRIEF DESCRIPTION OF THE SEVERAL VIEWS OF THE DRAWINGS

These and other features of the present invention will be more clearly understood from consideration of the following description, taken in connection with the accompanying drawings, in which.

DETAILED DESCRIPTION OF THE INVENTION

Figure 1:
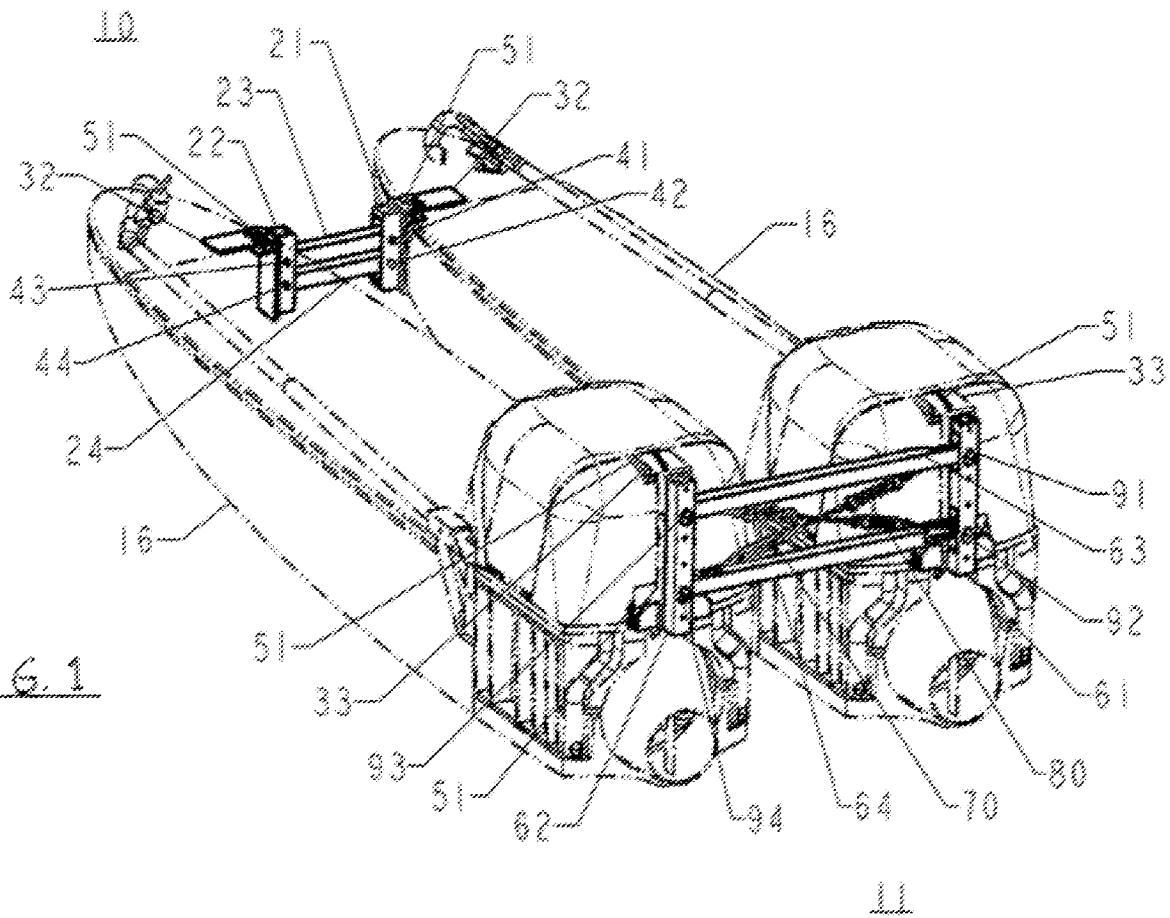
FIG. 1 is a rear perspective view of a pair of U.S. Pat. No. 5,643,029 Motorized Surf Boots, which shows the front and rear chassis assemblies installed. The chassis are shown supporting the surf boots or boards of U.S. Pat. No. 5,643,029 Motorized Surf Boots in the nominal orientation, as they would be when travelling in a straight direction.
Figure 2:
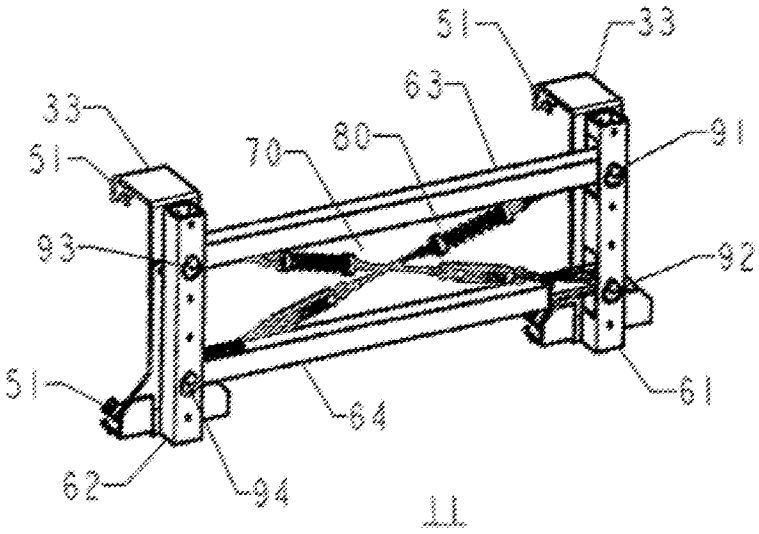
FIG. 2 is the same rear perspective view as FIG. 1, except showing the front and rear chassis assemblies by themselves, disassembled from the Motorized Surf Boots.
Figure 2:
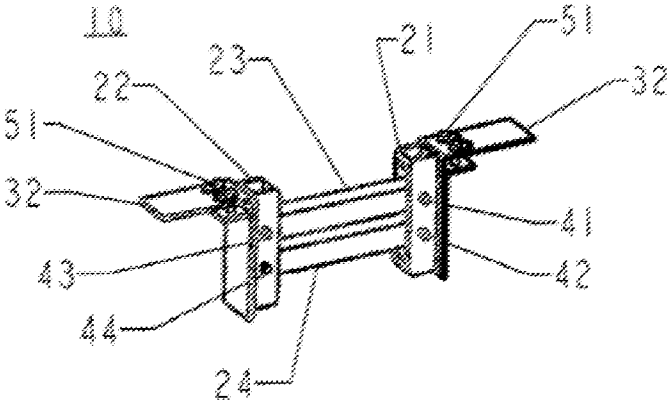

In the embodiment of the invention shows in FIG. 1-6, and their sub-parts, for use on Motorized Surf Boots, the chassis assemblies are illustrated by the reference numeral 10 for the front assembly, and by the reference numeral 11 for the rear assembly, both being attached to the pair of boards 16.

The front Chassis Assembly 10 of the present invention is composed of vertical links 21 and 22, and horizontal links 23 and 24 making comprising what is commonly known as a "four-bar linkage". The links 21, 22, 23, and 24 are connected at established pivot points 41, 42, 43, and 44 respectively, where quick release pins, bolts or any other suitable hardware can be implemented. The vertical links 21 and 22 are each attached to a bracket 32, which provide the rigid attachment to the boards or hulls, with the attachment being made by quick release pins 51, or screws, or bolts, or any other suitable attachment method, depending on whether one prefers a quick connect/release or not.

Similarly, the rear Chassis Assembly 11, is composed of a right-side vertical link 61 and a left side vertical link 62, and an upper horizontal link 63 and a lower horizontal links 64 which make up a four-bar linkage. Links 61, 62, 63, and 64 include holes at predetermined pivot axis locations 91, 92, 93, and 94 as shown, where quick release pins or any other suitable attachment hardware 51 are used, to allow the links to move freely.

Figures 3, 4:
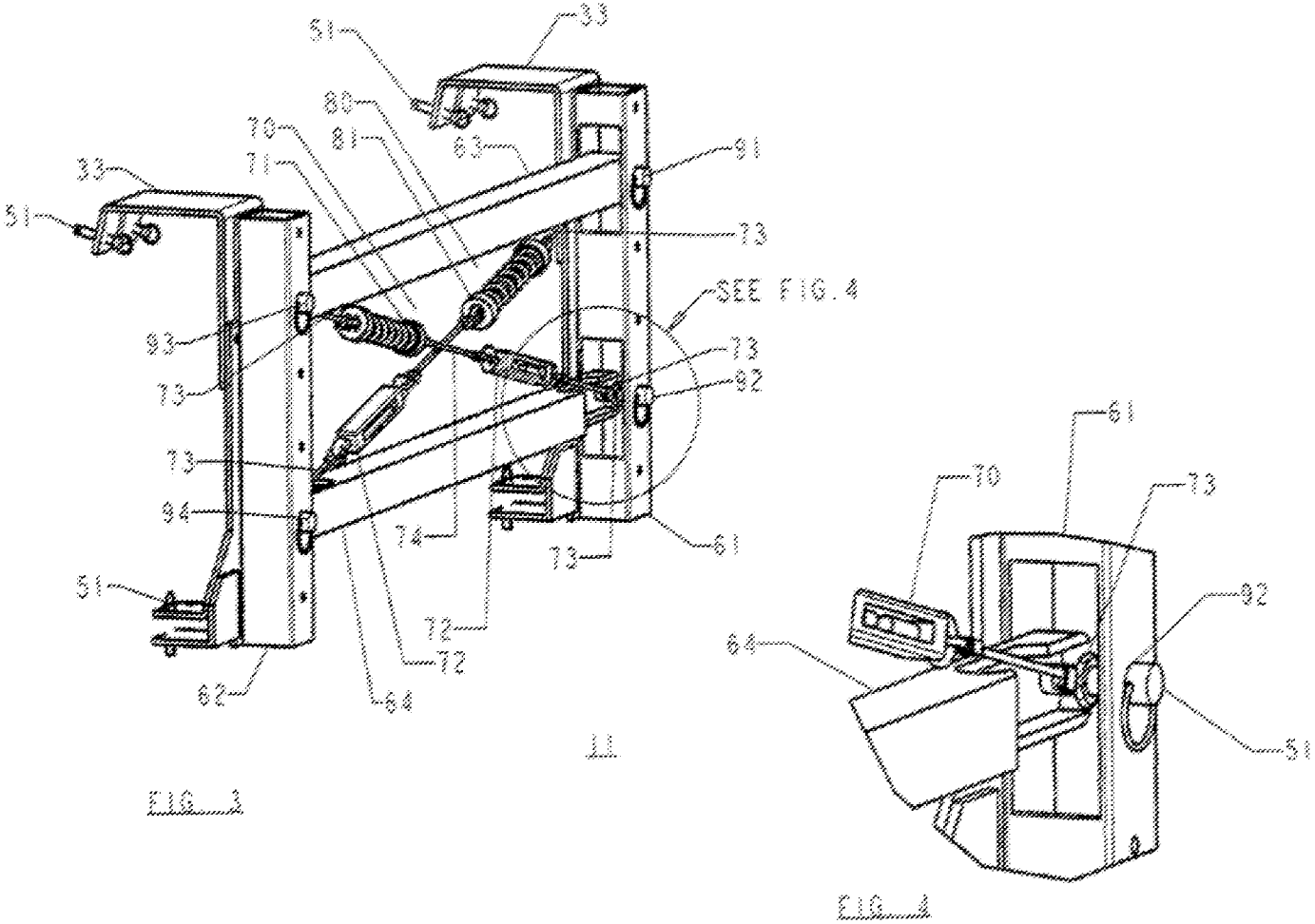
FIG. 3 is a close-up rear perspective view of the rear chassis assembly showing a detailed cutaway area.
FIG. 4 Is a closer-up detail view showing the cutaway area from FIG. 3.

The featured action of the present Chassis invention to be able to spring back into the center position after leaning or "carving" into a turn, may be accomplished in any number of ways, with one such option shown, in FIG. 1-6, by incorporation of two additional links 70 and 80, which will be seen to crisscross each other by attaching each link 70 and 80 to a top pivot axis on one side of the rear Chassis Assembly and extending to the lower pivot axis of the opposite side of the rear Chassis Assembly. The two additional links 70 and 80 are not a fixed length, rather they each have a spring and/or damper combination 71 and 81 installed, or any other suitable linear motion device, perhaps even electronic, that will allow the links 70 and 80 to change length due to a predetermined force applied. Included in the embodiment shown in the FIGS. 1-6, included as part of each crisscrossed link 70 and 80, is a commonly known "turnbuckle" device 72 used to adjust the tension of each of the links 70 and 80, and extension cables with an eyelet 73 to connect to pivot points 91, 92, 93, and 94 respectively. FIG. 4 shows a close-up cutaway view of the eyelet 73 attached at pivot axis 92. Additionally, intermediate cables 74 are used to complete the required length for each link 70 and 80.

Figure 5:
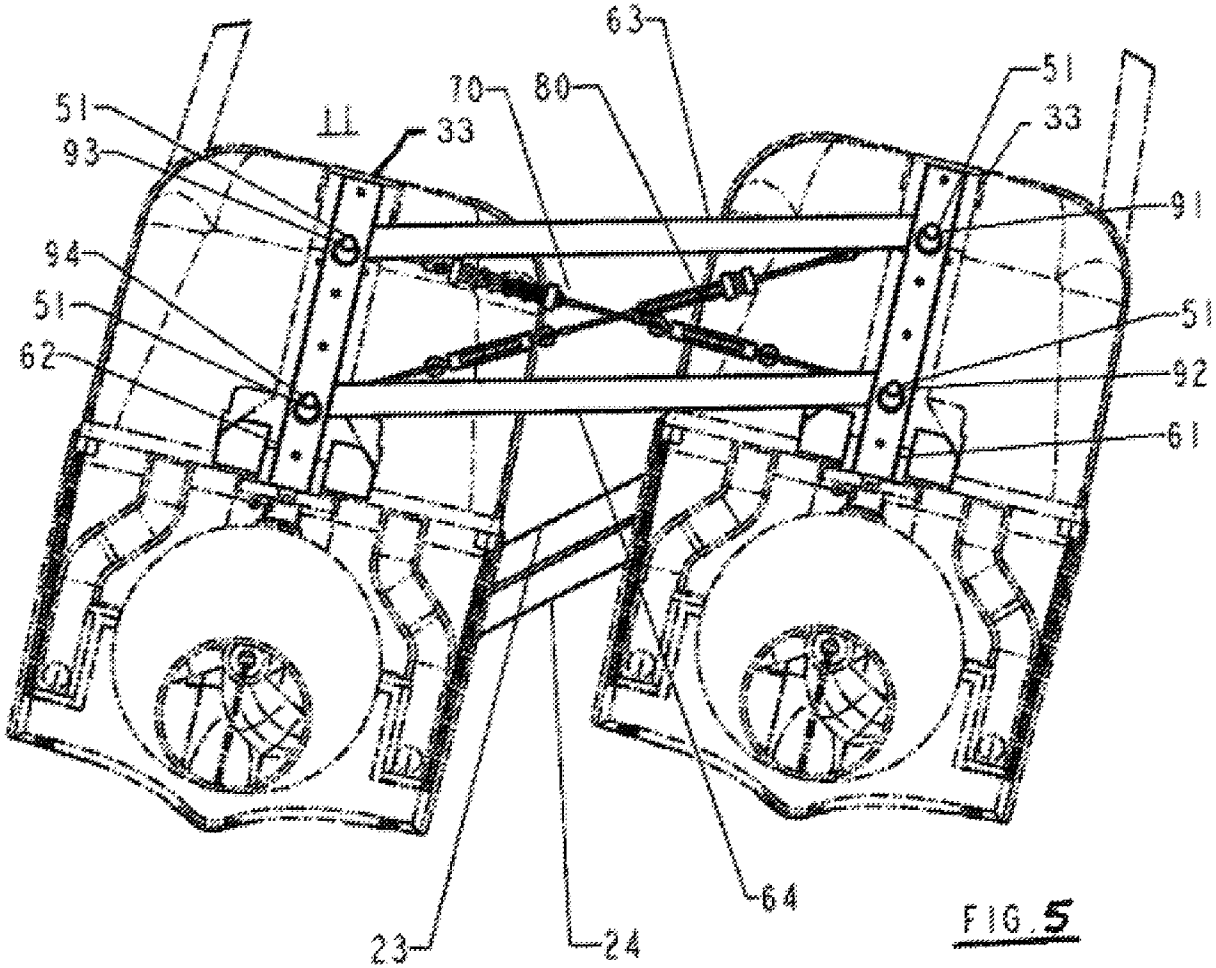
FIG. 5 is a rear view of Motorized Surf Boots with the Chassis Assemblies installed, and in a leaned over "carving" position, showing how one of the inner crisscrossed links results in being stretched within the four-bar linkage of the rear Chassis Assembly.
Figure 6:
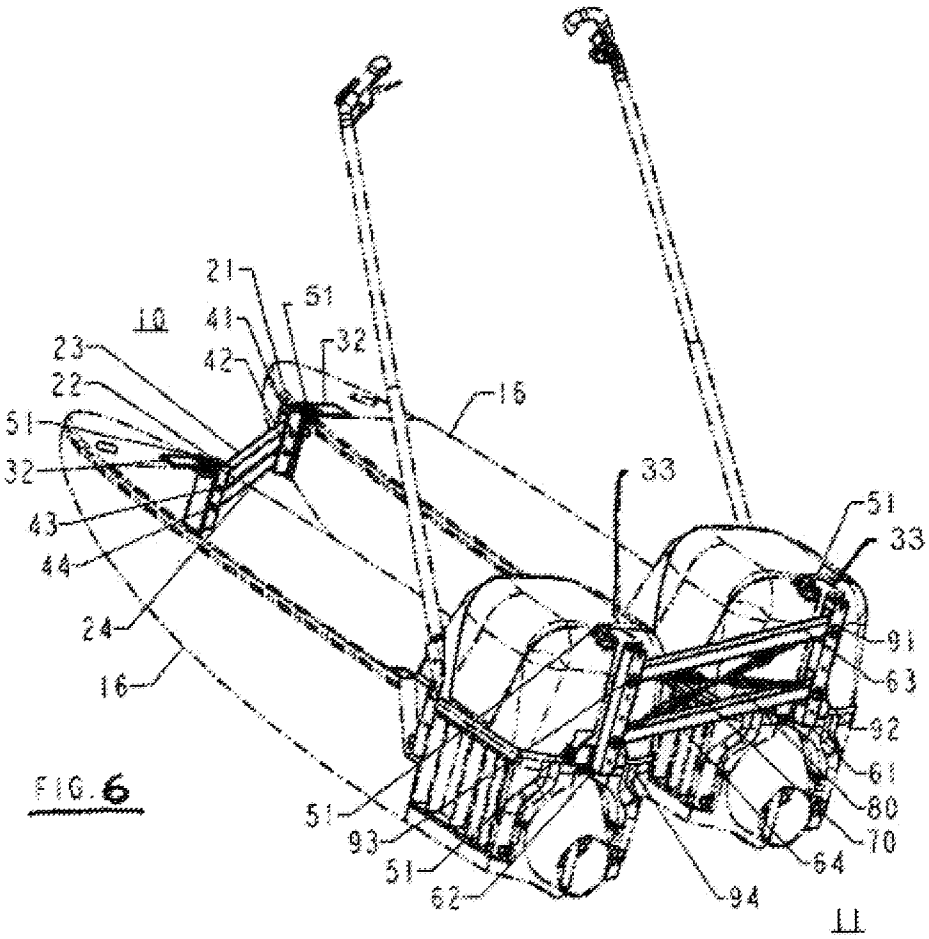
FIG. 6 is a rear perspective view of a pair of motorized surf boots with the Chassis Assemblies installed, and oriented in a leaned over "carving" position as when a rider would be "carving" into a turn.

Therefore, as can be seen, when the chassis is forced to one side by the leaning or "carving" action of the rider, to the right side as shown in FIGS. 5 and 6, this will cause the spring and/or damper link 81, to increase in length, while the other spring and/or damper link 71 will remain neutral. The stretched link 81 will want to spring back to the center position. The springs and/or dampers 71 or 81 can include a typical tension spring, or alternatively a safety draw-bar type spring as shown, in which the increased length of links 80 will cause the spring 81 to compress. Alternatively, the two spring fitted links 70 and 80 which provide the spring back action of the rear Chassis Assembly 11, can also be incorporated in the front Chassis Assembly 10 without considerable modification to the teaching herein.

Each of the rear Chassis Assembly vertical links 61 and 62 are further attached to a bracket 33, while on the front Chassis each of the links 21 and 22 is attached to a bracket 32 which in both cases provides the mounting features to the boards or hulls 16, using quick release pins 51 or any other appropriate hardware. As shown, Bracket 32 and 33 may need to be constructed in any number of suitable fashions for attaching links 61 and 62, or links 21 and 22 onto said board 16, without deviating from the teaching herein. Alternatively, Bracket 32 and 33 can be eliminated altogether, if the vertical links of the four-bar linkage are designed to include attachment features that will attach said links directly to the boards.

While there have been described what are considered to be preferred embodiments of the present invention, it will be readily appreciated by those skilled in the art, that modifications can be made without departing from the scope of the teachings herein. For at least such reason, therefore, resort should be had to the claims appended hereto for a true understanding of the scope of the invention.

I claim:

1. A carving apparatus of a multi-body vehicle comprising:

a front and a rear four-bar linkage which interconnects and keeps two boards or two hulls at a fixed distance, parallel, and in-line to each other;

said carving apparatus providing the two boards or two hulls, of the multi-body vehicle, an ability to lean into turns keeping the two boards or two hulls at parallel angles while rotating and leans into turns made by a rider leaning into turns while riding the multi-body vehicle;

wherein the two boards or two hulls provide parallel stabilization for both the front four bar linkage and the rear four bar linkage of the multi-body vehicle by having two parallel bars of the front four bar linkage and two parallel bars of the rear four bar linkage rigidly attached to the two boards or two hulls such that an angle of the two boards or two hulls defines an angle of the two parallel bars of the front four bar linkage and the two parallel bars of the rear four bar linkage allowing the rider of the multi-body vehicle to steer the multi-body vehicle by leaning into a turn and rotating the two boards or two hulls in a carving action.

2. The carving apparatus of claim 1, further comprising a spring or damper device connected between 2 or more pivot points of the front four bar linkage or the rear four bar linkage.

* * * * *